US005404691A

United States Patent [19]

Scherer

[11] Patent Number: 5,404,691

[45] Date of Patent: Apr. 11, 1995

[54] FILM-SEVERING MECHANISM FOR WRAPPING MACHINE AND RELATED METHOD

[75] Inventor: Phillip G. Scherer, Fort Lauderdale, Fla.

[73] Assignee: Mima Incorporated, Glenview, Ill.

[21] Appl. No.: 79,879

[22] Filed: Jun. 23, 1993

[51] Int. Cl.[6] ..... B65B 13/04; B65B 53/00

[52] U.S. Cl. ..... 53/399; 53/441; 53/556; 53/588

[58] Field of Search ..... 53/399, 441, 389.3, 53/556, 588

[56] References Cited

U.S. PATENT DOCUMENTS

| | | | |
|---|---|---|---|
| 4,110,957 | 9/1978 | Lancaster et al. | 53/588 X |
| 4,216,640 | 8/1980 | Kaufman | 53/556 |
| 4,545,182 | 10/1985 | McDowell | 53/588 X |
| 4,619,102 | 10/1986 | Geisinger | 53/399 |
| 4,628,671 | 12/1986 | Storm et al. | 53/588 |
| 5,005,335 | 4/1991 | Yourgalite et al. | 53/588 X |
| 5,027,581 | 7/1991 | Kovaes | 53/588 X |
| 5,088,270 | 2/1992 | Diehl | 53/588 X |

OTHER PUBLICATIONS

MSB-2245A/2445A Semiautomatic Stretch Bundlers Owner's Manual, 1991.

*Primary Examiner*—Linda B. Johnson
*Attorney, Agent, or Firm*—Schwartz & Weinrieb

[57] ABSTRACT

In a wrapping machine comprising a ring rotatable on a frame, a ledge to support a package being wrapped, and a carriage supporting a roll of plastic film and movable with the ring to wrap the film around the ledge and around a package supported thereby, a severing arm, pivotable between a horizontal position underlying the ledge and a vertical position, carries a heated severing wire. Also, a spacing arm, pivotably movable between a horizontal position underlying the ledge and a vertical position, spaces an outer film layer from the ledge. In one embodiment, the severing arm carries heated welding elements, and the spacing arm applies a partial vacuum to cause a severed film portion to adhere to the spacing arm. In another embodiment, the severed film portion is clamped between the spacing and severing arms.

24 Claims, 4 Drawing Sheets

Fig. 3
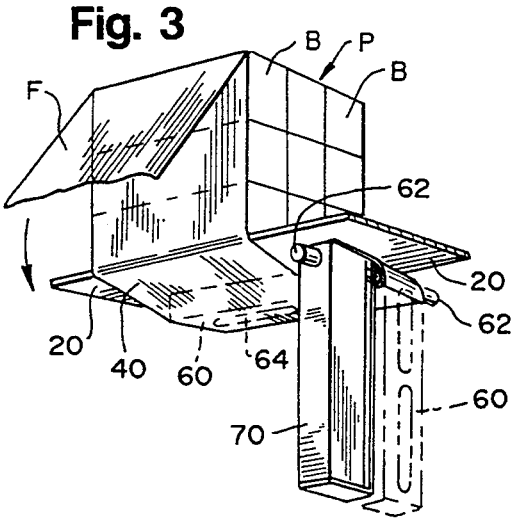
Fig. 4
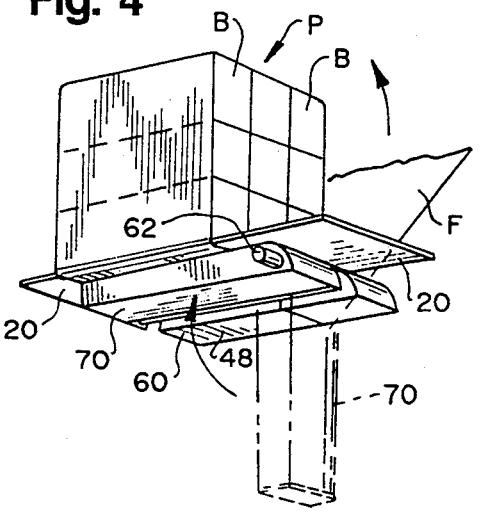
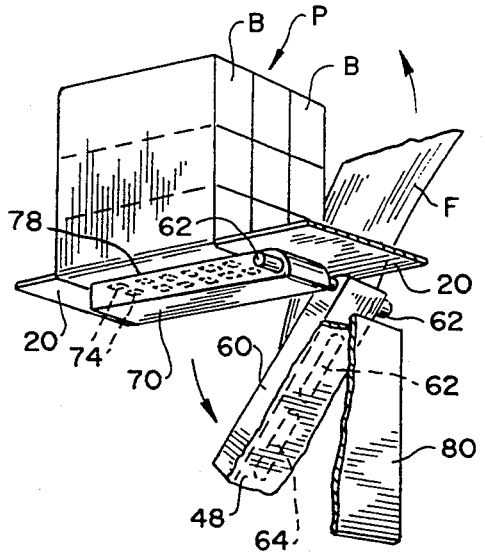
Fig. 5
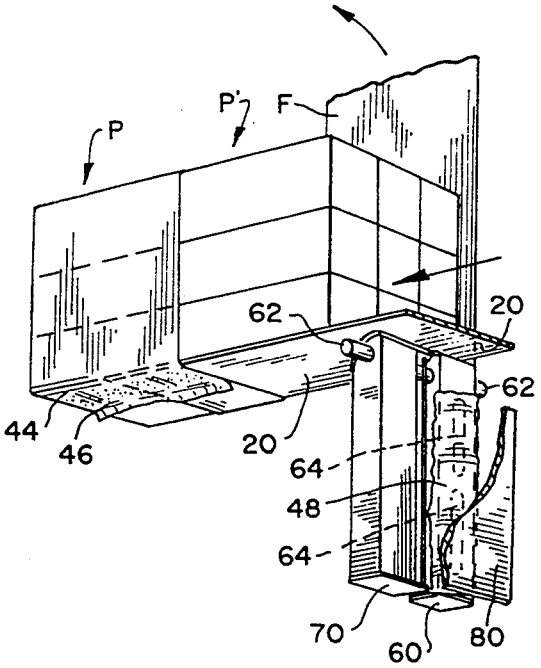
Fig. 6

Fig. 10
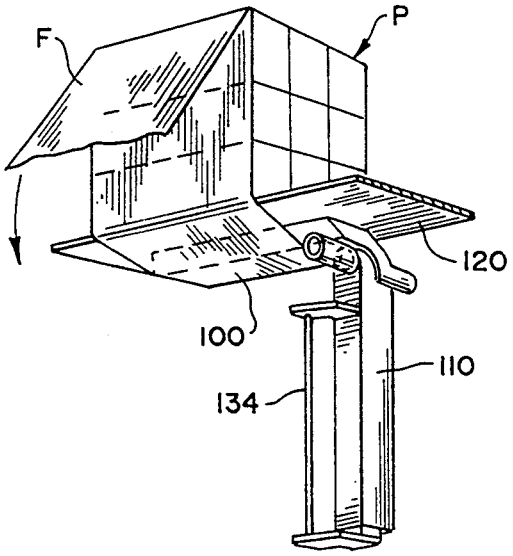
Fig. 11
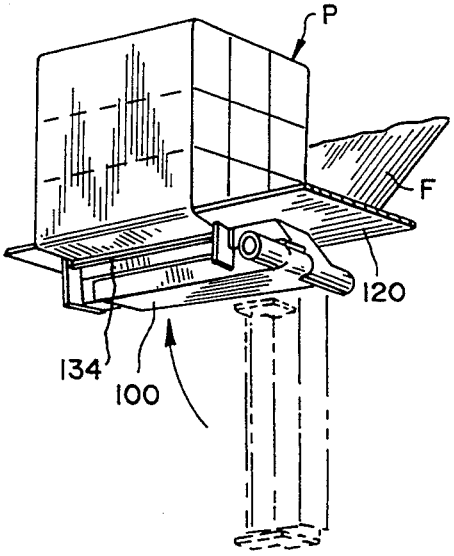
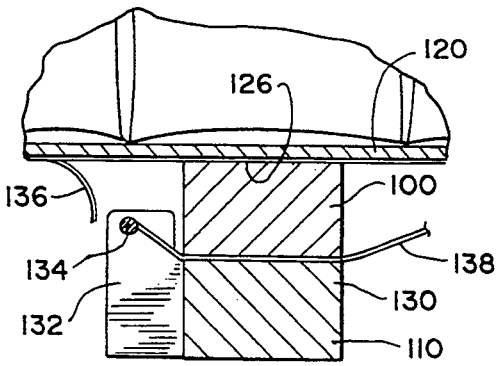
Fig. 12
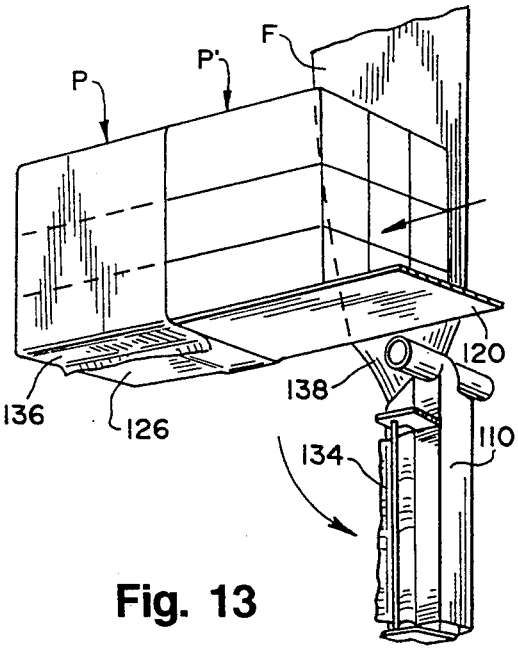
Fig. 13

FILM-SEVERING MECHANISM FOR WRAPPING MACHINE AND RELATED METHOD

TECHNICAL FIELD OF THE INVENTION

This invention pertains to a film-severing mechanism useful in a machine for wrapping a package with plastic film supplied on a roll, and to a related method. The mechanism is arranged to space a portion of an outer film layer from the next prior film layer and to sever the spaced portion along a generally straight line. The mechanism may also be arranged to weld a portion of the severed film layer to and across the next prior film layer and to remove another portion of the severed film layer.

BACKGROUND OF THE INVENTION

A machine of a type in widespread use for wrapping packages with plastic film supplied on a roll, such as stretch film, comprises a frame, a ring rotatable on the frame and defining a circular path around a horizontal axis, a support extending horizontally toward an open center of the ring and arranged to support a package being wrapped, and a carriage mounted upon the ring for conjoint movement with the ring and arranged to support the roll of film with its axis parallel to the horizontal axis of the ring. The support may be a ledge or a conveyor. The carriage is movable along the circular path, around the ledge, when the ring is rotated so that film from the roll supported by the carriage is wrapped in successive layers, around the support and around a package supported by the support, as the carriage is moved around the ring.

A leading edge of the film is secured to the package, as by taping, before the film is wrapped therearound. After the support and the package supported by the support have been wrapped with plural layers of the film, the wrapped film is severed from the film remaining on the roll, and an outer layer of the wrapped film is secured to the next prior layer of the wrapped film, commonly by welding or taping.

Such wrapping machines are available commercially, as "MSB Stretch Bundlers", from ITW Mima (a unit of Illinois Tool Works Inc.) of Boca Raton, Fla. Manual machines are known, in which the carriage is moved manually along the circular path defined by the ring. Powered machines are known, in which the carriage is moved by a motor.

In a wrapping machine of the type noted above, as known heretofore, the film of the outer layer is bunched into a rope-like configuration when such film is severed from the film remaining on the roll. Generally, the rope-like configuration is retained when the outer layer is secured to the next prior layer, particularly if welding or taping is used.

Such a rope-like configuration can interfere with stacking or palletizing of the package with other packages. Also, such a rope-like configuration may lend an unsatisfactory appearance to a package, particularly if the package is placed into a retail store without removal of the film wrapping the package.

There has therefore been a need, to which this invention is addressed, for a better way to sever the film of the outer layer from the film remaining on the roll.

SUMMARY OF THE INVENTION

This invention provides an improved, film-severing mechanism useful in a machine for wrapping a package with plastic film supplied on a roll, where the machine comprises a support for supporting a package being wrapped and for being wrapped with the package. The plastic film may be stretch film.

According to this invention, the improved, film-severing mechanism comprises means for spacing a portion of an outer film layer from at least one prior film layer wrapped around the support and around a package supported by the support, and means for severing the outer film layer at the spaced portion, along a generally straight line extending across the spaced portion, into a first portion integral with film wrapped around the support, and around a package supported by the support, and a second portion integral with film on the roll. Preferably, moreover, the wrapping machine comprises means for welding the first portion of the severed film layer to the next prior film layer, and means for removing the second portion of the severed film layer from the wrapped support and from the wrapped package supported by the support.

In a preferred embodiment, a spacing and removing arm is mounted so as to be pivotally movable between a generally horizontal position, in which the spacing and removing arm underlies the support with any prior film layer between the spacing and removing arm and the support and in which the spacing arm is disposed so as to also be wrapped by an outer film layer and to space a portion of the outer film layer from the next prior film layer, and a generally vertical position, in which the spacing and removing arm does not interfere with film being wound around the support and around a package supported by the support.

In the preferred embodiment, a severing and welding arm is mounted so as to be pivotally movable between a generally horizontal position, in which the severing and welding arm underlies the support with the outer film layer between the severing and welding arm and the support, and a generally vertical position, in which the severing and welding arm does not interfere with film being wound around the support and around a package supported by the support.

Moreover, in the preferred embodiment, the severing and welding arm carries a heated wire constituting means for severing the spaced portion of the outer film layer into a first portion integral with film wrapped around the support and around a package supported by the support, and a second portion integral with film on the roll. Furthermore, in the preferred embodiment, the severing and welding arm carries other heated elements constituting means for welding the first portion of the severed film layer to and across the next prior film layer.

Additionally, in the preferred embodiment, a fixed wall is disposed so as to enable the spacing and removing arm to clamp the second portion of the severed film layer against the fixed wall when the spacing and removing arm with the second portion of the film adhering thereto is pivoted from the horizontal position to the vertical position.

As a further feature of the preferred embodiment, the spacing and removing arm comprises means for applying a partial vacuum to the second portion of the severed film layer so as to cause the second portion of the severed film layer to adhere to the spacing and removing arm as the spacing and removing arm is pivoted from the horizontal position to the vertical position.

This invention also provides a related method of severing an outer layer of plastic film from a next prior layer of such film, along a generally straight line, after at least one prior layer of such film has been wrapped around a support and around a package on the support.

BRIEF DESCRIPTION OF THE DRAWINGS

These and other objects, features, and advantages of this invention will be evident from the following description of a preferred embodiment of this invention with reference to the accompanying drawings, in which like reference characters designate like or corresponding parts throughout the several views, and wherein:

FIGS. 3, 4, 5, and 6, on the scale of FIG. 1, are fragmentary, schematic, perspective views showing successive stages in the operation of the preferred embodiment.

FIG. 10 is a fragmentary view based on FIG. 9 and showing the spacing and severing arms clamping one severed portion of a severed film layer; and FIGS. 11–13 are views similar to those of FIGS. 4, 9, AND 6, Respectively, with FIG. 12 being an enlarged, fragmentary view corresponding to that of FIG. 9 and at a different point in time of the film wrapping operation.

DETAILED DESCRIPTION OF ILLUSTRATED EMBODIMENTS

Figure 1:
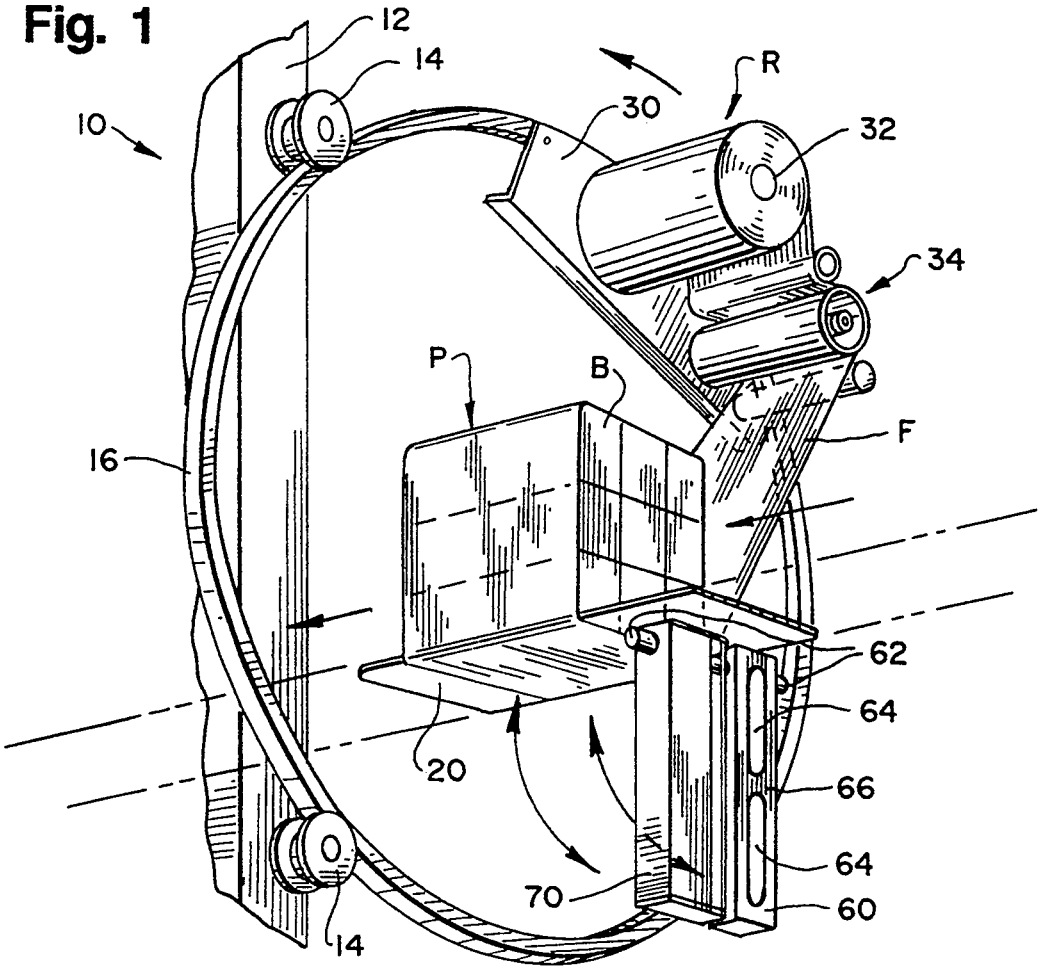
FIG. 1 is a fragmentary, perspective view of a wrapping machine constituting a preferred embodiment of this invention. Broadly, as shown, the wrapping machine comprises a ring, a carriage moving along the ring and supporting a roll of stretch film, a ledge supporting a package being wrapped along with the ledge, and two pivotable arms, namely a spacing and removing arm and a severing and welding arm. Each arm is shown as pivoted to a vertical position.

As shown in FIGS. 1 through 6, a machine 10 for wrapping a package P with plastic film F supplied on a roll R defining a roll axis constitutes a preferred embodiment of this invention. As shown, the package P is comprised of nine elongate boxes B stacked in three rows and three columns. Preferably, the film F is stretch film, which is available commercially from many sources including ITW Mima, supra.

As shown fragmentarily, the machine 10 comprises a frame 12 mounting grooved rollers 14 and a ring 16, which is rotatably mounted upon the frame 12 through means of the rollers 14 in a known manner. The ring 16 defines a ring axis, which is horizontal. Also, the ring 16 defines a circular path and has an open center.

Further, the machine 10 comprises a ledge 20, which is fixed to the frame 12 in a known manner. The ledge 20 extends horizontally toward and through the open center of the ring 16 and is arranged to support the package P being wrapped.

Moreover, the machine 10 comprises a carriage 30, which is mounted fixedly mounted upon the ring 16 so that the carriage 30 is moved along the circular path, around the ledge 20, when the ring 16 is rotated about the ring axis. The carriage 30 may be so moved by means of a motor (not shown) in a known manner or manually. The carriage 30 is arranged to support the roll R, by means of a spindle 32 extending from the carriage 30 and permitting the roll R to rotate on the roll axis, with the roll axis parallel to the ring axis. The carriage 30 mounts a prestretching mechanism 34 of a known type (see, e.g., Lancaster et al. U.S. Pat. No. 4,302,920) which mechanism 34 is used to prestretch the film F as the film F is unwound from the roll R.

A leading edge of the film F is pulled from the roll R, through the prestretching mechanism 34, and is secured to the package P supported on the ledge 20, as by taping. Next, the ring 16 and the carriage 30 are rotated in the direction indicated by the curved arrow in FIG. 1, so as to wrap the film F in successive layers around the ledge 20 and around the package P supported by the ledge 20. Next, an outer layer of the film F is severed from the film F remaining on the roll R, whereupon a trailing end of the outer layer is secured to the package P, as by welding or taping the trailing end to the next prior layer of the film F wrapped therearound. Finally, the wrapped package P is pushed from the ledge 20, as by a similar package P' to be wrapped next.

As described so far, the machine 10 is conventional and is similar to one of the "MSB Stretch Bundlers" available commercially from ITW Mima, supra. Broadly, the operation of the machine 10 is similar to the operation of the same "MSB Stretch Bundlers".

However, the machine 10 comprises novel means described below for spacing a portion 40 of an outer layer 42 of the film F from the next prior layer 44 of the film F wrapped around the ledge 20 and around the package P supported by the ledge 20, for severing the outer layer 42 at the spaced portion 40, along a generally straight line extending across the spaced portion 40, into a first portion 46 integral with the film F wrapped therearound and a second portion 48 integral with the film F remaining on the roll R, for welding the first portion 46 to and across the next prior layer 44, and for removing the second portion 48 from the ledge 20 and from the package P supported by the ledge 20.

The spacing and removing means comprise a spacing and removing arm 60 pivotably mounted upon the frame 12, by means of a pivot pin 62, so as to be pivotable between a generally horizontal position and a generally vertical position. A pneumatic or otherwise powered mechanism (not shown) is provided for pivoting the arm 60 selectively between the generally horizontal and generally vertical positions. For a purpose to be later described, the arm 60 has two elongate cavities 64 opening at one planar surface 66 of the arm 60, which surface 66 faces downwardly when the arm 60 is pivoted to the generally horizontal position. The elongate cavities 64 communicate with a vacuum line V (see FIG. 2) which is connected to a vacuum pump (not shown) or other known means for applying a partial vacuum.

Figure 2:
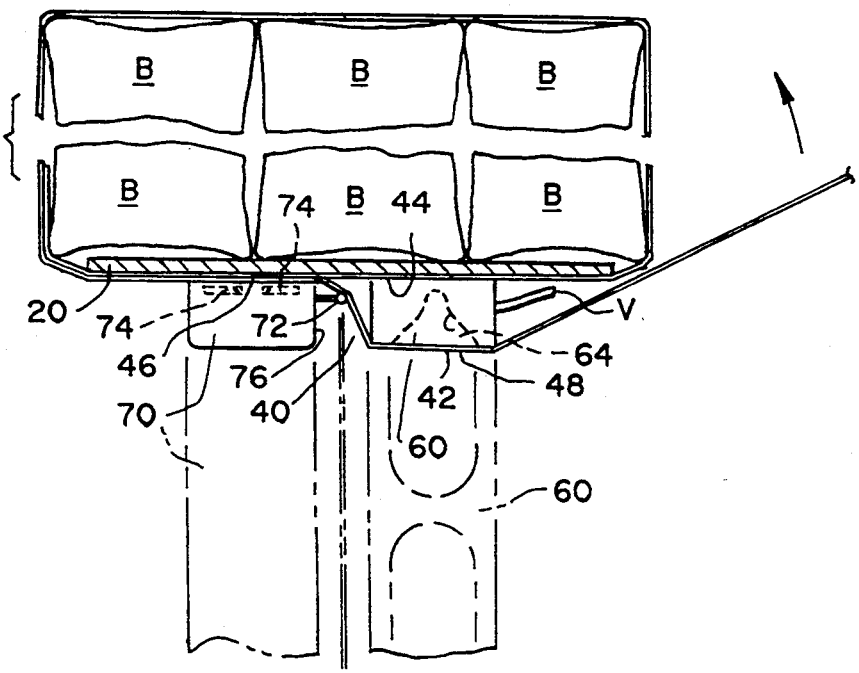
FIG. 2, on an enlarged scale, is a fragmentary, schematic, elevational view showing the film being wrapped around the ledge and around the package, showing the spacing and removing arm as pivoted to a horizontal position, in which the spacing and removing arm spaces a portion of an outer film layer from the next prior film layer, and showing the severing and welding arm as pivoted to a horizontal position, in which a heated wire severs the outer film layer at the spaced portion and in which heated welding elements weld a portion of the severed film layer to the next prior film layer.

In the generally horizontal position, in which the arm 60 is shown in solid lines in FIGS. 2, 3, and 4, the arm 60 underlies the ledge 20 with any prior film layer being confined between the arm 60 and the ledge 20. In the generally horizontal position, the arm 60 is disposed so as to also be wrapped by the outer layer 42 of the film F and to space the aforenoted portion 40 of the outer layer 42 from the next prior layer 44 of the film F, generally as shown in FIG. 2.

In the generally vertical position, in which the arm 60 is shown in solid lines in FIGS. 1 and 6, the arm 60 does not interfere with the film F being wound around the ledge 20 and around the package P supported by the ledge 20.

The severing and welding means comprise a severing and welding arm 70 also pivotably mounted upon the frame 12, by means of the pivot pin 62 used to mount the arm 60, so as to be pivotable between a generally horizontal position and a generally vertical position. A pneumatic or otherwise powered mechanism (not shown) is provided for pivoting the arm 70 selectively between the generally horizontal and generally vertical positions. The arm 70 carries a severing wire 72, which is arranged to be electrically heated in a known manner, and an array of welding elements 74, which are arranged to be similarly heated.

In the generally vertical position, in which the arm 70 is shown in FIGS. 1, 3, and 6, the arm 70 does not interfere with the film F being wound around the ledge 20 and around the package P supported by the ledge 20.

The severing wire 72 is carried along one side 76 of the arm 70 so as to extend across the spaced portion 40 of the outer layer 42 of the film F, after such portion 40 has been spaced from the next prior layer 44 of the film F by the arm 60, when the arm 70 is pivoted from the generally vertical position to the generally horizontal position. When the severing wire 72 engages the spaced portion 40, the severing wire 72 is heated so as to sever the outer layer 42 at the spaced portion 40 into the first portion 46 integral with the film F wrapped around the ledge 20 and around the package P supported by the ledge 20, and the second portion 48 integral with the film F remaining on the roll R.

The welding elements 74 are carried by the arm 70 so as to extend along one planar surface 78 of the arm 70, which surface 78 faces upwardly when the arm 70 is pivoted to the generally horizontal position. The welding elements 74 are covered by a thin layer of a protective material, which preferably is polytetrafluoroethylene (PTFE) tape. When the arm 70 is pivoted to the generally horizontal position, the welding elements 74 are heated so as to weld the first portion 46 of the severed outer layer 42 of the film F to and across the next prior layer 44 of the film F, as the arm 70 presses the first portion 46 of the film F against the next prior layer 44 of the film F.

When the outer layer 42 of the film F is severed by the severing wire 72, a partial vacuum is applied to the elongate cavities 64 of the arm 60, by means of the vacuum line V, so as to cause the second portion 48 of the severed outer layer 42 to adhere to the arm 60. Thereupon, as shown in FIG. 5, the arm 60 is pivoted from the generally horizontal position to the generally vertical position with the second portion 48 continuing to adhere to the arm 60 because of the partial vacuum applied thereto.

The machine 10 comprises a wall 80 fixed to the frame 12. The wall 80 is disposed so as to enable the arm 60 to clamp the second portion 48 of the severed film of the severed outer layer 42 of the film F against the wall 80 when the arm 60 with the second portion 48 of the severed film adhering thereto is pivoted from the generally horizontal position to the generally vertical position.

After the outer layer 42 of the film F has been severed and the first portion 46 of the severed outer layer 42 has been welded to the next prior layer 44, the arm 70 is pivoted from the generally horizontal position to the generally vertical position. Another package P' similar to the wrapped package P may then be pushed onto the ledge 20 so as to displace the wrapped package P, which may be thus stripped from the ledge 20.

The film portion 48 clamped between the arm 60 and the wall 80 may then be released so as to provide the leading edge of the film F to be then used to wrap the package P' in a manner similar to that performed in connection with package P.

As shown in FIGS. 7 through 13, a spacing arm 100 and a severing arm 110 are substitutable for the spacing and removing arm 60 and the severing and welding arm 70, in a wrapping machine constituting an alternative embodiment of this invention. Except for the arms 100, 110, and except for a ledge 120, which is similar to the ledge 20 of the wrapping machine 10 and which supports a package P being wrapped with wrapping film F from a roll (not shown) so as to also be wrapped with the film F, the wrapping machine constituting the alternative embodiment is similar to the wrapping machine 10.

Figure 7:
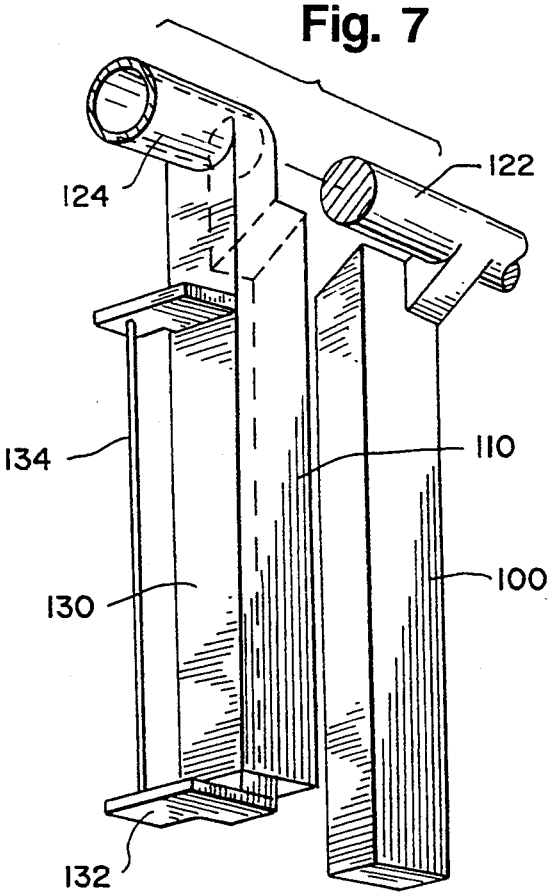
FIG. 7 is a perspective, exploded view of the spacing and severing arms of a wrapping machine constituting an alternative embodiment of this invention.
Figure 8:
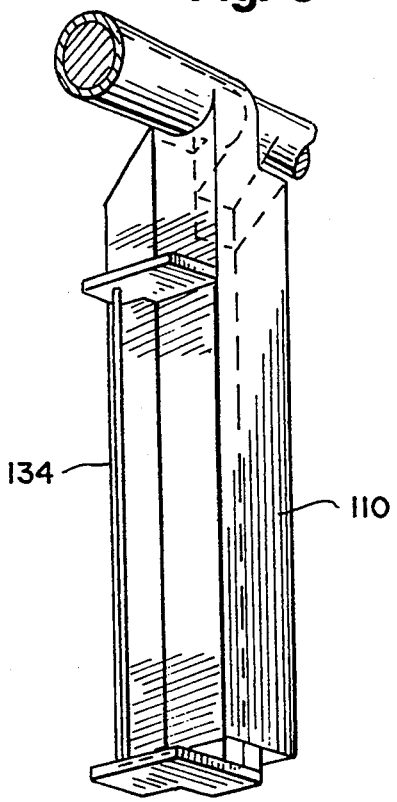
FIG. 8 is a perspective, assembled view of the spacing and severing arms shown in FIG. 7.

As shown in FIGS. 7 and 8, a pivot pin 122 defining a pivot axis is integral with the spacing arm 100 and extends through a sleeve 124, which is integral with the severing arm 110. The pivot pin 122 is journalled so that each of the arms 100, 110, can be pivotally moved about the pivot axis, between a generally horizontal position and a generally vertical position.

Figure 9:
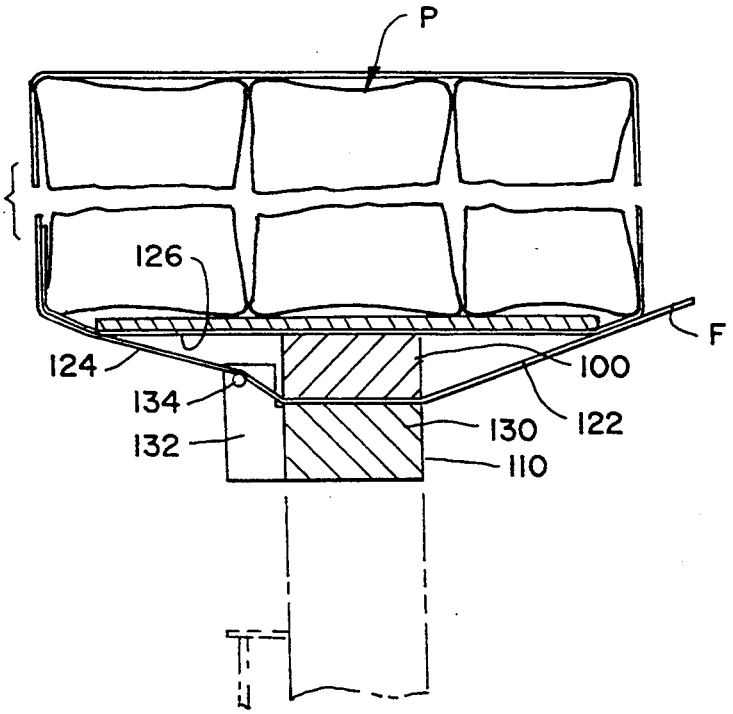
FIG. 9 is a fragmentary, schematic, elevational view analogous to FIG. 2 but showing the spacing and severing arms of the alternative embodiment.

In the generally horizontal position, in which the spacing arm 100 is shown in solid lines in FIGS. 11, 12, and 13, the arm 100 underlies the ledge 120 with any prior film layer being confined between the arm 100 and the ledge 120. In the generally horizontal position, the spacing arm 100 is disposed so as to also be wrapped by the outer layer 122 of the film F and to space a portion 124 of the outer layer 122 from the next prior layer 126 of the film F, generally as shown in FIG. 9.

In the generally vertical position, in which the spacing arm 100 is shown in FIGS. 7, 8, 11, and 13, the spacing arm 100 does not interfere with the film F being wound around the ledge 120 and around the package P supported by the ledge 120.

The severing arm 110 has a clamping portion 130 and a severing portion 132. The clamping portion 130 extends along and behind the spacing arm 100 when both arms 100, 110, are in their generally horizontal positions and when both arms 100, 110, are in their generally vertical positions. The clamping portion 130 interferes with the spacing arm 100 so as to prevent the severing arm 110 from pivoting to its generally horizontal position unless the spacing arm 100 has been pivoted or is being pivoted to its generally horizontal position. The severing portion 132 carries a severing wire 134, which is arranged to be electrically heated in a known manner, and which is analogous to the severing wire 72 described above.

In the generally vertical position, in which the severing arm 110 is shown in FIGS. 7, 8, 11, and 13, the arm 110 does not interfere with the film F being wound around the ledge 120 and around the package P supported by the ledge 120.

The severing wire 134 is carried along the severing portion 132 of the severing arm 110 so as to extend across the spaced portion 124 of the outer layer 122 of the film F, after such portion 124 has been spaced from the next prior layer 126 of the film F by the arm 100, when the arm 110 is pivoted from the generally vertical position to the generally horizontal position. When the severing wire 134 engages the spaced portion 124 of the outer layer 122 of the film F, the severing wire 134 is heated so as to sever the outer layer 122 of the film F at the spaced portion 124 into a first portion 136 integral with the film F wrapped around the ledge 120 and around the package P supported by the ledge 120, and a second portion 138 integral with the film F remaining on the roll, as sown in FIG. 12.

As the spaced portion 124 of the outer film layer 122 is severed by the severing wire 134, the second portion 138 of the severed film layer 122 becomes clamped between the clamping portion 130 of the severing arm 110 and the spacing arm 100. Thereupon, when the arms 100, 110, are pivoted conjointly from their generally horizontal positions to their generally vertical positions, the second portion 138 of the severed film layer 122 remains clamped therebetween.

The first portion 136 of the severed film layer 122 may be secured, as by taping, to the next prior film layer 126. If the film F has a tacky surface, which is conventional, taping may be unnecessary.

Various modifications may be made in either embodiment described above without departing from the scope and spirit of this invention as defined by means of the appended claims. It is therefore to be understood that within the scope of the appended claims, the present invention may be practiced otherwise than as specifically described herein.

I claim:

1. A mechanism used with a machine for wrapping a package, disposed upon a support of said machine, with plastic film supplied from a roll, and for severing an outer layer of said film from a next prior layer of said film wrapped around said support and said package, wherein said film extends along a predetermined circular path about said support and said package, comprising:

first means for spacing a portion of said outer film layer from said next prior film layer wrapped around said support and said package, and disposed at a first location upon said predetermined circular path; and second means, disposed at a second location upon said predetermined circular path which is circumferentially spaced along said predetermined circular path from said first location at which said first means is located, for severing said outer film layer, at a third location which is interposed between said circumferentially spaced first and second locations at which said first and second means are located, into a first portion which is integral with said film wrapped around said support and said package, and a second portion which is integral with said film disposed upon said roll.

2. The mechanism of claim 1 wherein the spacing means comprises a spacing arm mounted so as to be pivotably movable between a generally horizontal position, in which the spacing arm underlies the support with any prior film layer being confined between the spacing arm and the support and in which the spacing arm is disposed to be also wrapped by the outer film layer and to space a portion of the outer film layer from the next prior film layer, and a generally vertical position, in which the spacing arm does not interfere with film being wound around the support and around the package.

3. The mechanism of claim 2 wherein the severing means comprises a severing arm mounted so as to be pivotably movable between a generally horizontal position, in which the severing arm underlies the support with the outer film layer between the severing arm and the support, and a generally vertical position, in which the severing arm does not interfere with film being wound around the support and around the package, the severing arm carrying a heated wire arranged to sever the outer film layer.

4. The mechanism of claim 1 further comprising means for welding the first portion of the severed film layer to and across the next prior film layer.

5. The mechanism of claim 4 wherein the severing and welding means comprise a severing and welding arm mounted so as to be pivotably movable between a generally horizontal position, in which the severing and welding arm underlies the support with the outer film layer between the severing and welding arm and the support, and a generally vertical position, in which the severing and welding arm does not interfere with film being wound around the support and around the package, the severing and welding arm carrying a heated wire arranged to sever the outer film layer and carrying other heated elements arranged to weld the first portion of the severed film layer to and across the next prior film layer.

6. The mechanism of claim 1 further comprising means for removing the second portion of the severed film layer from the wrapped support and from the wrapped package.

7. The mechanism of claim 6 wherein the spacing and removing means comprises a spacing and removing arm mounted so as to be pivotably movable between a generally horizontal position, in which the spacing and removing arm underlies the support with any prior film layer being confined between the spacing and removing arm and the support and in which the spacing and removing arm is disposed to be also wrapped by the outer film layer and to space a portion of the outer film layer from the next prior film layer, and a generally vertical position, in which the spacing and removing arm does not interfere with film being wound around the support and around the package, the spacing and removing arm comprising means for applying a partial vacuum to the second portion of the severed film layer so as to cause the second portion of the severed film layer to adhere to the spacing and removing arm as the spacing and removing arm is pivoted from the generally horizontal position to the generally vertical position.

8. The mechanism of claim 7 further comprising a fixed wall disposed to enable the spacing and removing arm to clamp the second portion of the severed film layer against the fixed wall when the spacing and removing arm with the second portion adhering thereto is pivoted from the generally horizontal position to the generally vertical position.

9. A mechanism, used with a machine for wrapping a package, disposed upon a support of said machine, with plastic film supplied from a roll, for severing an outer layer of said film from a next prior layer of said film wrapped around said support and said package, comprising:

a spacing arm mounted with respect to said support so as to be pivotably movable between a first, substantially horizontal position, at which said spacing arm underlies said support such that a prior film layer is confined between said spacing arm and said support, and wherein further, said spacing arm is disposed so as to be wrapped by an outer film layer so as to space a portion of said outer film layer from said next prior film layer; and a second, substantially vertical position at which said spacing arm does not interfere with film being wrapped around said support and said package supported by said support;

a severing arm mounted with respect to said support so as to be pivotably movable between a first, substantially horizontal position, at which said severing arm underlies said support such that said severing arm engages said spacing arm whereby said outer film layer is clamped between said severing arm and said spacing arm; and a second substantially vertical position at which said severing arm does not interfere with film being wrapped around said support and said package supported by said support;

said severing arm carrying a heated wire constituting means, located externally of said spacing and severing arms when said spacing arm and said severing arm are engaged with each other and said outer film layer is clamped between said severing arm and said spacing arm, for severing said spaced portion of said outer film layer into a first portion which is integral with said film wrapped around said support and said package, and a second portion which is integral with said film disposed upon said roll; and said spacing and severing arms constituting means for clamping said second portion of said severed film layer between said spacing and severing arms so as to remove said clamped second portion of said severed film layer from said wrapped support and said wrapped package as said spacing and severing arms are pivoted from said first, substantially horizontal positions to said second, substantially vertical positions.

10. A mechanism used with a machine for wrapping a package disposed upon a support of said machine, with plastic film supplied from a roll, and for severing an outer layer of said film from a next prior layer of said film wrapped around said support and said package, wherein said film extends along a predetermined circular path about said support and said package, comprising:

a spacing and removing arm mounted with respect to said support so as to be pivotably movable between a first, substantially horizontal position, at which said spacing and removing arm underlies said support such that any prior film layer is confined between said spacing and removing arm and said support, and in addition, said spacing and removing arm is disposed at a first location upon said predetermined circular path so as to be wrapped by an outer film layer and thereby space a portion of said outer film layer from the next prior film layer; and a second, substantially vertical position at which said spacing and removing arm does not interfere with film being wrapped around said support and said package supported by said support; and a severing and welding arm disposed at a second location upon said predetermined circular path which is circumferentially spaced along said predetermined circular path from said first location at which said spacing and removing arm is located and mounted with respect to said support so as to be pivotably movable between a first, substantially horizontal position at which said severing and welding arm engages said support such that said outer film layer is confined between said severing and welding arm and said support; and a second, substantially vertical position at which said severing and welding arm does not interfere with film being wrapped around said support and said package supported by said support;

said severing and welding arm carrying a heated wire constituting first means for severing a spaced portion of said outer film layer, at a third location which is interposed between said circumferentially spaced first and second locations at which said spacing and removing arm, and said severing and welding arm, are respectively located, into a first portion which is integral with said film wrapped around said support and said package, and a second portion which is integral with said film disposed upon said roll; and carrying additional heating elements constituting second means for welding said first portion of said severed outer film layer to said next prior film layer wrapped around said support and said package.

11. The mechanism of claim 10 further comprising a fixed wall disposed to enable the spacing and removing arm to clamp the second portion of the severed film layer against the fixed wall when the spacing and removing arm with the second portion adhering thereto is pivoted from the generally horizontal position to the generally vertical position, the spacing and removing arm comprising means for applying a partial vacuum to the second portion of the severed film layer so as to cause the second portion of the severed film layer to adhere to the spacing and severing arm as the spacing and severing arm is pivoted from the generally horizontal position to the generally vertical position whereby said second portion of said severed film layer can be clamped between said spacing and removing arm and said fixed wall.

12. A method of severing an outer layer of plastic film, supplied from a roll, from a next prior layer of said plastic film, after at least one prior layer of said plastic film has been wrapped around a support and a package support upon said support, comprising the steps of:

positioning a spacing arm adjacent to said support;

wrapping said outer film layer around said spacing arm, as well as around said support and said package supported upon said support, so as to space portion of said outer film layer from said next prior film layer;

positioning a severing arm adjacent to said support so as to engage said support and clamp a first portion of said outer film layer between said severing arm and said support;

severing a second portion of said outer film layer, which is spaced from said next prior film layer by said spacing arm, into a first portion which is integral with said film wrapped around said package and said support, and a second portion which is integral with said roll; and removing said second severed portion of said outer film layer, which is integral with said roll, while said severing arm remains engaged with said support and said first severed portion of said outer film layer, which is integral with said film wrapped around said package and said support, remains clamped between said severing arm and said support.

13. The method of claim 12 further comprising steps of applying a partial vacuum so to cause the second portion of the severed film layer to adhere to the spacing arm and repositioning the spacing arm so as to remove the second portion of the severed film layer from the wrapped support and from the wrapped package.

14. The method of claim 12 wherein the severing step is effected by positioning said severing arm near the support, the severing arm carrying a heated wire, which severs the spaced portion of the outer film layer.

15. The method of claim 12 further comprising a step of welding the first portion of the severed film layer to and across the next prior film layer.

16. The method of claim 15 wherein the severing and welding steps are effected by positioning a severing and welding arm near the support, the severing and welding arm carrying a heated wire, which severs the spaced portion of the outer film layer, the severing and welding arm carrying heated welding elements, which weld the first portion of the severed film layer to and across the next prior film layer.

17. A mechanism, used with a machine for wrapping a package, disposed upon a support of said machine, with plastic film supplied from a roll, for severing an outer layer of said film from a next prior layer of said film wrapped around said support and said package, comprising:

a first arm means for spacing a portion of said outer film layer from said next prior film layer wrapped around said support and said package; and a second arm means for engaging said support so as to confine a first portion of said outer film layer between said second arm means and said support, and for severing a second portion of of said outer film layer, spaced from said next prior film layer by said first arm means, into a first section which is integral with said first portion of said outer film layer confined between said second arm means and said support, and a second section which is integral with said film disposed upon said roll and which is removable with said roll while said second arm means remains engaged with said support such that said first portion of said outer film layer remains confined between said second arm means and said support.

18. The mechanism as set forth in claim 17, wherein:

said second arm means along a circular path comprising a direction of wrapping said package with said plastic film.

19. The mechanism as set forth in claim 17, further comprising:

a heated wire carried by said second arm means for severing said second portion of said outer film layer into said first and second severed sections; and a plurality of heating elements carried by said second arm means for welding said first severed section of said outer film layer to said next prior film layer.

20. The mechanism as set forth in claim 19, further comprising:

vacuum means incorporated within said first arm means for causing adherence of said second severed section of said outer film layer to said first arm means after said outer film layer is severed by said heated wire of said second arm means so as to permit said removal of said second severed section by said first arm means.

21. A method of severing an outer layer of plastic film, supplied from a roll, from a next prior layer of said plastic film, after at least one prior layer of said plastic film has been wrapped around a support and a package disposed upon said support, comprising the steps of:

positioning a spacing arm adjacent to said support;

wrapping said outer film layer around said spacing arm, as well as around said support and said package disposed upon said support, so as to space a first portion of said outer film layer from said next prior film layer;

positioning a severing arm adjacent to said spacing arm so as to clamp a second portion of said outer film layer between said spacing and severing arms, wherein said first portion of said outer film layer is disposed externally of engagement surfaces of said spacing and severing arms, by means of which said second portion of said outer film layer is clamped between said spacing and severing arms, when said severing arm and said spacing arm are engaged with each other;

severing said outer film layer at said first portion of said outer film layer disposed externally of said engagement surfaces of said spacing and severing arms when said spacing arm and said severing arm are engaged with each other so as to sever said outer film layer into a first severed portion which is integral with said film wrapped around said package and said support, and a second severed portion which is integral with said film disposed upon said roll;

securing said first severed portion of said outer film layer to said next prior film layer wrapped around said package and said support; and moving said clamped spacing and severing arms, with said second severed portion of said outer film layer clamped therebetween, away from said support and said package disposed upon said support in preparation for a subsequent film wrapping operation.

22. The method as set forth in claim 21, wherein:

said severing of said outer film layer is performed by providing said severing arm with a heated wire disposed externally of said engagement surfaces of said spacing and severing arms.

23. A method of severing an outer layer of plastic film, supplied from a roll, from a next prior layer of said plastic film, after at least one prior layer of said plastic film has been wrapped around a support and a package supported upon said support, wherein said film extends along a predetermined circular path about said support and said package, comprising the steps of:

positioning a first spacing arm adjacent to said support at a first location upon said predetermined circular path;

wrapping said outer film layer around said first spacing arm, as well as around said support and said package supported upon said support, so as to space a portion of said outer film layer from said next prior film layer;

positioning a second severing arm adjacent to said support, at a second location upon said predetermined circular path which is circumferentially spaced along said predetermined circular path from said first location at which said first spacing arm is located, so as to engage said support and clamp a first portion of said outer film layer between said second severing arm and said support; and severing a second portion of said outer film layer, which is spaced from said next prior film layer by said first spacing arm, at a third location which is interposed between said circumferentially spaced first and second locations at which said first and second spacing and severing arms are located, into a first severed portion which is integral with said film wrapped around said support and said package, and a second severed portion which is integral with said film disposed upon said roll.

24. A method as set forth in claim 23, further comprising the steps of:

activating vacuum means incorporated within said first spacing arm for causing adherence of said second severed portion of said outer film layer to said first spacing arm so as to facilitate removal of said second severed portion of said outer film layer from said wrapped support and wrapped package by movement of said first spacing arm, with said second severed portion of said outer film layer adhered thereto, away from said support; and energizing heating elements incorporated within said second severing arm for welding said first severed portion of said outer film layer to said next prior film layer.

* * * * *